US008761427B2

(12) United States Patent
Akino

(10) Patent No.: US 8,761,427 B2
(45) Date of Patent: Jun. 24, 2014

(54) DYNAMIC MICROPHONE UNIT AND DYNAMIC MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 34 days.

(21) Appl. No.: 13/587,274

(22) Filed: Aug. 16, 2012

(65) Prior Publication Data

US 2013/0058510 A1 Mar. 7, 2013

(30) Foreign Application Priority Data

Sep. 2, 2011 (JP) ..... 2011-191660

(51) Int. Cl.
*H04R 25/00* (2006.01)

(52) U.S. Cl.
USPC ..... 381/375; 381/369; 381/355

(58) Field of Classification Search
USPC ..... 381/355, 369, 375
See application file for complete search history.

(56) References Cited

U.S. PATENT DOCUMENTS 4,017,694 A * 4/1977 King ..... 381/415
4,637,489 A * 1/1987 Iwanaka et al. ..... 181/160

FOREIGN PATENT DOCUMENTS

JP 2005-260306 A 9/2005
JP 2006-019791 A 1/2006

* cited by examiner

*Primary Examiner* — Davetta W Goins
*Assistant Examiner* — Amir Etesam
(74) *Attorney, Agent, or Firm* — Whitham Curtis Christofferson & Cook, PC

(57) ABSTRACT

A dynamic microphone unit includes: a diaphragm vibrating in response to received sound waves; a voice coil fixed to the diaphragm and vibrating in cooperation with the diaphragm; a magnetic circuit generating magnetism in a magnetic gap, the voice coil being disposed in the magnetic gap; a first air chamber defined adjacent to the reverse of the diaphragm; and a second air chamber defined behind the voice coil, the second air chamber being in communication with the first air chamber, an elastic thin-plate acoustic resistor being disposed in the second air chamber while having tensile force applied, at a position where the acoustic resistor limits the volume of the second air chamber and comes into contact with the voice coil within a maximum displacement of the voice coil.

8 Claims, 11 Drawing Sheets

DYNAMIC MICROPHONE UNIT AND DYNAMIC MICROPHONE

TECHNICAL FIELD

The present invention relates to a dynamic microphone unit and a dynamic microphone, and in particular, to a reduction in impact sound caused by a large displacement of a diaphragm in response to excessive acoustic pressure.

BACKGROUND ART

Omnidirectional components of a dynamic microphone are controlled by resistance (resistance control). The dynamic microphone is therefore provided with an acoustic resistor disposed immediately behind a diaphragm to achieve flat frequency response.

FIGS. 7 and 8 illustrate a typical conventional dynamic microphone unit 200. As illustrated in FIGS. 7 and 8, a unit case 1 functions as a base of the microphone unit. The unit case 1 is a cylinder having a bottom surface. The unit case 1 has an inner cylinder 11 integrated thereto and extends from the top toward the bottom. A round flange 12 extends from the bottom of the inner cylinder 11 of the unit case 1 inward in the radial direction.

The inner cylinder 11 of the unit case 1 accommodates a magnetic circuit composed of the following magnetic circuit components. A dish-shaped yoke 2 fixed into the inner cylinder 11 is supported by the flange 12 of the inner cylinder 11. The outer surface of the circumferential wall of the yoke 2 is in contact with the inner circumferential surface of the inner cylinder 11. A disk magnet 3 fixed on the bottom plate of the yoke 2 has a smaller outer diameter than the inner diameter of the circumferential wall of the yoke 2. A disk pole piece 4 is fixed on the magnet 3. A ring yoke 21 is fixed on the top surface of the circumferential wall of the yoke 2. The pole piece 4 has substantially the same thickness as that of the ring yoke 21. The pole piece 4 and the ring yoke 21 are fixed so as to be substantially flush with each other. The outer circumferential surface of the pole piece 4 faces the inner circumferential surface of the ring yoke 21 with a proper gap to define a round magnetic gap. Most of these magnetic circuit components are contained in the inner cylinder 11. The top surface of the pole piece 4 is substantially flush with the top surface of the inner cylinder 11.

A magnetic flux from the magnet 3 returns to the magnet 3 through a magnetic circuit composed of the yoke 2, the ring yoke 21, the magnetic gap, and the pole piece 4. In other words, the magnetic flux traverses the magnetic gap. The magnet 3 has a smaller outer diameter than the outer diameter of the pole piece 4. An air chamber 9 having a larger width than that of the magnetic gap is defined between the outer circumferential surface of the magnet 3 and the inner circumferential surface of the ring yoke 21 below the magnetic gap. The yoke 2 has multiple through holes 22 at the bottom portion. The holes 22 connect the air chamber 9 to a space surrounded by the round flange 12 of the unit case 1.

The unit case 1 has a projection edge 14 along the outer circumference at the top. The unit case also has a concentric projection 13 inside the projection edge 14, the projection 13 having a height lower than the projection edge 14 on the top of the unit case 1. The circumferential edge of a diaphragm 5 is fixed on the top surface of the projection 13. The diaphragm 5 is a thin film composed of a material such as synthetic resin or metal. The diaphragm 5 includes a center dome 51 and a sub-dome 52 surrounding the center dome 51. The center dome 51 is a partial spherical shell. The sub-dome 52 has an arc-shaped cross section and extends along the circumferential edge of the center dome 51. The diaphragm 5 is fixed at its outer circumferential edge of the sub-dome 52, on the top surface of the projection 13. This enables the diaphragm 5 to vibrate in response to the sound pressure from received sound waves, in the anteroposterior direction (the vertical direction in FIG. 7) around the outer circumferential edge of the sub-dome 52 as a supporting node.

A voice coil 6 is fixed along a round boundary line between the center dome 51 and the sub-dome 52 in the diaphragm 5. The voice coil 6 is formed by winding a thin conductive wire and by fixing it into a cylindrical shape. One end of the cylindrical voice coil 6 is fixed to the diaphragm 5. The voice coil 6 is disposed in the magnetic gap while the outer circumferential edge of the sub-dome 52 in the diaphragm 5 is fixed to the projection 13 as described above. In this state, the voice coil 6 is separated from both the ring yoke 21 and the pole piece 4.

Near the obverse of the diaphragm 5, an equalizer 8 functioning also as a protector for the diaphragm 5 is fixed, at its circumferential edge, to the projection edge 14 of the unit case 1. The equalizer 8 has a ceiling surface having a dome shape in the center. A gap with a predetermined distance is defined between the ceiling surface and the center dome 51 of the diaphragm 5. The equalizer 8 has multiple holes 82 for introducing sound waves from the exterior to the diaphragm 5.

The bottom of the unit case 1 is closed to provide a relatively large air chamber 15 in the unit case 1. In the air chamber 15, an acoustic resistor 16 adheres to the bottom surface of the yoke 2. The flange 12 of the unit case 1 has a cylindrical inner surface. The inner surface of the flange 12 supports the outer circumferential of the acoustic resistor 16. The acoustic resistor 16 is composed of, for example, a thick-ply unwoven fabric. The acoustic resistor 16 is disposed adjacent to the reverse of the diaphragm 5. A space adjacent to the reverse of the diaphragm 5 is in communication with the acoustic resistor 16 through the magnetic gap, the air chamber 9, and the holes 22 of the yoke 2. The space adjacent to the reverse of the diaphragm 5 is also in communication with the air chamber 15.

The diaphragm 5 vibrates in the anteroposterior direction in response to a variation in the sound pressure from received sound waves. The voice coil 6 also vibrates in the anteroposterior direction in cooperation with the diaphragm 5. The voice coil 6 vibrates to traverse the magnetic flux passing through the magnetic gap. The voice coil 6 traverses the magnetic flux to generate electric power as audio signals in response to a variation in the sound pressure. A dynamic microphone unit 200 electro-acoustically converts the signals as described above. For example, audio signals are outputted from both ends of the voice coil 6 wired along the reverse of the sub-dome 52 to the exterior.

In such a configuration of the dynamic microphone unit 200, the space adjacent to the reverse of the diaphragm 5 is partitioned by the voice coil 6 into a space adjacent to the reverse of the center dome 51 and another space adjacent to the reverse of the sub-dome 52. In the dynamic microphone unit 200, these spaces are in communication with each other through magnetic gaps adjacent to the inner circumferential surface and adjacent to the outer circumferential surface of the voice coil 6. The sensitivity of the dynamic microphone unit 200 can be effectively improved by decreasing the widths of the magnetic gaps. In the dynamic microphone unit 200, the widths of the magnetic gaps are therefore as decreased as possible provided that the voice coil 6 does not come into contact with the pole piece 4 and the ring yoke 21. As a result, the space adjacent to the reverse of the diaphragm 5 is substantially partitioned by the voice coil 6 into the spaces adjacent to the reverse of the center dome 51 and adjacent to the reverse of the sub-dome 52, as described above.

The acoustic capacitance of the space adjacent to the reverse of the center dome 51 is referred to as Sc, and the acoustic capacitance of the space adjacent to the reverse of the sub-dome 52 to as Ss. The acoustic mass and the acoustic resistance of a gap between the inner circumferential surface of the voice coil 6 and the outer circumferential surface of the pole piece 4 are referred to as mgi and rgi, respectively. The acoustic mass and the acoustic resistance of a gap between the outer circumferential surface of the voice coil 6 and the inner circumferential surface of the ring yoke 21 are referred to as mgo and rgo, respectively. Sound pressure applied to the obverse of the diaphragm 5 is referred to as P1, the acoustic resistance of the acoustic resistor 16 disposed in the air chamber 15 of the unit case 1 to as r1, the acoustic mass of the air chamber adjacent to the obverse of the diaphragm 5 to as mo, and the acoustic capacitance of the adjacent air chamber to as So. The acoustic capacitance of the air chamber 9 between the inner surface of the circumferential wall of the yoke 2 and the outer circumferential surface of the magnet 3 is referred to as Sg. Accordingly, the acoustic capacitance Sc of the space adjacent to the reverse of the center dome 51 is connected to the acoustic capacitance Ss of the space adjacent to the reverse of the sub-dome 52 through the acoustic mass mgi, the acoustic resistance rgi, the acoustic capacitance Sg, the acoustic mass mgo, and the acoustic resistance rgo, as illustrated in FIG. 8.

FIG. 9 illustrates an equivalent circuit of the dynamic microphone unit 200 including the acoustic mass, the acoustic capacitance, and the acoustic resistance illustrated in FIGS. 7 and 8. The equivalent circuit of the dynamic microphone unit 200 illustrated in FIG. 9 includes the sound pressure P1, the acoustic mass mo, the acoustic capacitance So, the acoustic mass mgi, the acoustic resistance rgi, the acoustic resistance rgo, the acoustic mass mgo, and the acoustic capacitance Ss, which are connected in series. In the equivalent circuit of the dynamic microphone unit 200, connection nodes between the acoustic capacitance So and the acoustic mass mgi and between the sound pressure P1 and the acoustic capacitance Ss are connected to the acoustic capacitance Sc. In the equivalent circuit of the dynamic microphone unit 200, connection nodes between the acoustic resistance rgi and the acoustic resistance rgo and between the sound pressure P1 and the acoustic capacitance Ss are connected to the acoustic resistance r1 and the acoustic capacitance S1 connected in series. In the equivalent circuit of the dynamic microphone unit 200, the acoustic capacitance Sg is connected in parallel to the acoustic resistance r1 and the acoustic capacitance S1 connected in series.

As is apparent from the equivalent circuit of the dynamic microphone unit 200 in FIG. 9, a resonant circuit is defined by the acoustic mass mgi adjacent to the inner circumference of the magnetic gap partitioned by the voice coil 6 and the acoustic capacitance Sg of the air chamber 9. In the equivalent circuit of the dynamic microphone unit 200, another resonant circuit is defined by the acoustic mass mgo adjacent to the outer surface of the magnetic gap and the acoustic capacitance Ss of a space adjacent to the reverse of the sub-dome 52. The air chamber 9 has a small volume in comparison with that of the air chamber 15 occupying the lower half of the unit case 1. As is apparent from the equivalent circuit of the dynamic microphone unit 200, the acoustic capacitance Sg and the acoustic mass mgi readily resonate in cooperation. The resonance causes a peak in a specific frequency in the dynamic microphone unit 200 and leads to improper frequency characteristics.

In order to decrease the resonance, the volume of the air chamber 9 may be further decreased to minimize the acoustic capacitance Sg to a negligible level to prevent the acoustic capacitance Sg from resonating with the acoustic mass mgi. FIG. 10 illustrates such a configuration of a typical conventional dynamic microphone unit 300. In the dynamic microphone unit 300, an acoustic resistor 25 is disposed in an air chamber 9 between the inner circumferential surface of the circumferential wall of a yoke 2 and the outer circumferential surface of a magnet 3. In the dynamic microphone unit 300, the acoustic resistor 25 is shifted to so as to be in contact with the bottom surface of the yoke 2. In the dynamic microphone unit 300, an air chamber 9 is provided above the top surface of the acoustic resistor 25. This causes the acoustic resistor 25 to limit the volume of the air chamber 9, resulting in a significantly small acoustic capacitance Sg of the air chamber 9. The acoustic capacitance Sg is connected to an acoustic capacitance S1 through the acoustic resistance r1 of the acoustic resistor 25 and holes 22 of the yoke 2. FIG. 11 illustrates an equivalent circuit of the dynamic microphone unit 300. In the equivalent circuit of the dynamic microphone unit 300 illustrated in FIG. 11, the acoustic capacitance Sg is limited to a negligible level, i.e., a significantly small acoustic capacitance by the existence of the acoustic resistor 25, as described with reference to FIG. 10. The acoustic capacitance Sg is therefore omitted in FIG. 11. As described above, the dynamic microphone unit 300 illustrated in FIG. 10 can prevent resonance caused by the air chamber 9 to provide proper frequency characteristics not having a peak in an audible frequency band.

In order to dispose the acoustic resistor 25 in the air chamber 9 behind a voice coil 6 as described above to significantly decrease the volume of the air chamber 9, the acoustic resistor 25 must be disposed near the voice coil 6. If the acoustic resistor 25 is composed of a felt material, unwoven fabric, or an unwoven fabric material, fibers 251 of the acoustic resistor 25 partly rises as illustrated in FIG. 10. If the diaphragm 5 vibrates exceedingly, the voice coil 6 comes into contact with the fibers 251 to generate abnormal noise. In addition, the fibers 251 disturb vibration of the voice coil 6 in accurate response to sound waves to cause inaccurate electro-acoustic conversion. The dynamic microphone unit 300 therefore has a limited reduction in a distance between the acoustic resistor 25 and the voice coil 6. The dynamic microphone unit 300 also has a limited reduction in the acoustic capacitance Sg by a decrease in the volume of the air chamber 9. Even the dynamic microphone unit 300 having such a configuration therefore can prevent limited resonance caused by the air chamber 9.

The present inventor proposed a dynamic microphone including a voice coil having lead wires along the inner surface of a sub-dome of a diaphragm facing a ring yoke, and a magnetism generator circuit provided with amplitude restriction means that restricts the maximum displacement of vibration of the diaphragm toward a pole piece to a position at which the lead wires do not come into contact with the ring yoke (see Japanese Unexamined Patent Application Publication No. 2005-260306).

The present inventor also proposed a dynamic microphone including a voice coil having lead wires elastically held on a sub-dome through an elastic layer painted on the inner surface of the sub-dome of a diaphragm adjacent to the voice coil, so as not to break the lead wires even if the diaphragm is biased against a magnetism generator circuit (Japanese Unexamined Patent Application Publication No. 2006-019791).

SUMMARY OF INVENTION

Technical Problem

The techniques described in Japanese Unexamined Patent Application Publications Nos. 2005-260306 and 2006-019791, however, have a disadvantage of noise caused by collision of a diaphragm with a fixation unit.

It is an object of the present invention to provide a dynamic microphone unit and a dynamic microphone including the dynamic microphone unit that can reduce impact noise caused by a large displacement of a diaphragm.

Solution to Problem

A dynamic microphone unit in an embodiment of the present invention includes: a diaphragm vibrating in response to received sound waves; a voice coil fixed to the diaphragm and vibrating in cooperation with the diaphragm; a magnetic circuit generating magnetism in a magnetic gap, the voice coil being disposed in the magnetic gap; a first air chamber defined adjacent to the reverse of the diaphragm; and a second air chamber defined behind the voice coil, the second air chamber being in communication with the first air chamber, a elastic thin-plate acoustic resistor being disposed in the second air chamber at a position where the acoustic resistor comes into contact with the voice coil within a maximum displacement of the voice coil.

Advantageous Effects of Invention

In the present invention, the thin-plate acoustic resistor limits the volume of the second air chamber behind the voice coil and thus prevents the resonance of the acoustic mass of the magnetic gap with the acoustic capacitance of the second air chamber. The dynamic microphone unit of the present invention therefore exhibits proper frequency characteristics. In the present invention, the thin-plate acoustic resistor is disposed under applied tensile force. The acoustic resistor therefore warps when a large displacement of the voice coil causes contact of the voice coil with the acoustic resistor. Accordingly, the present invention can absorb impact force caused by collision of the voice coil to reduce impact noise.

DESCRIPTION OF EMBODIMENTS

Figure 7:
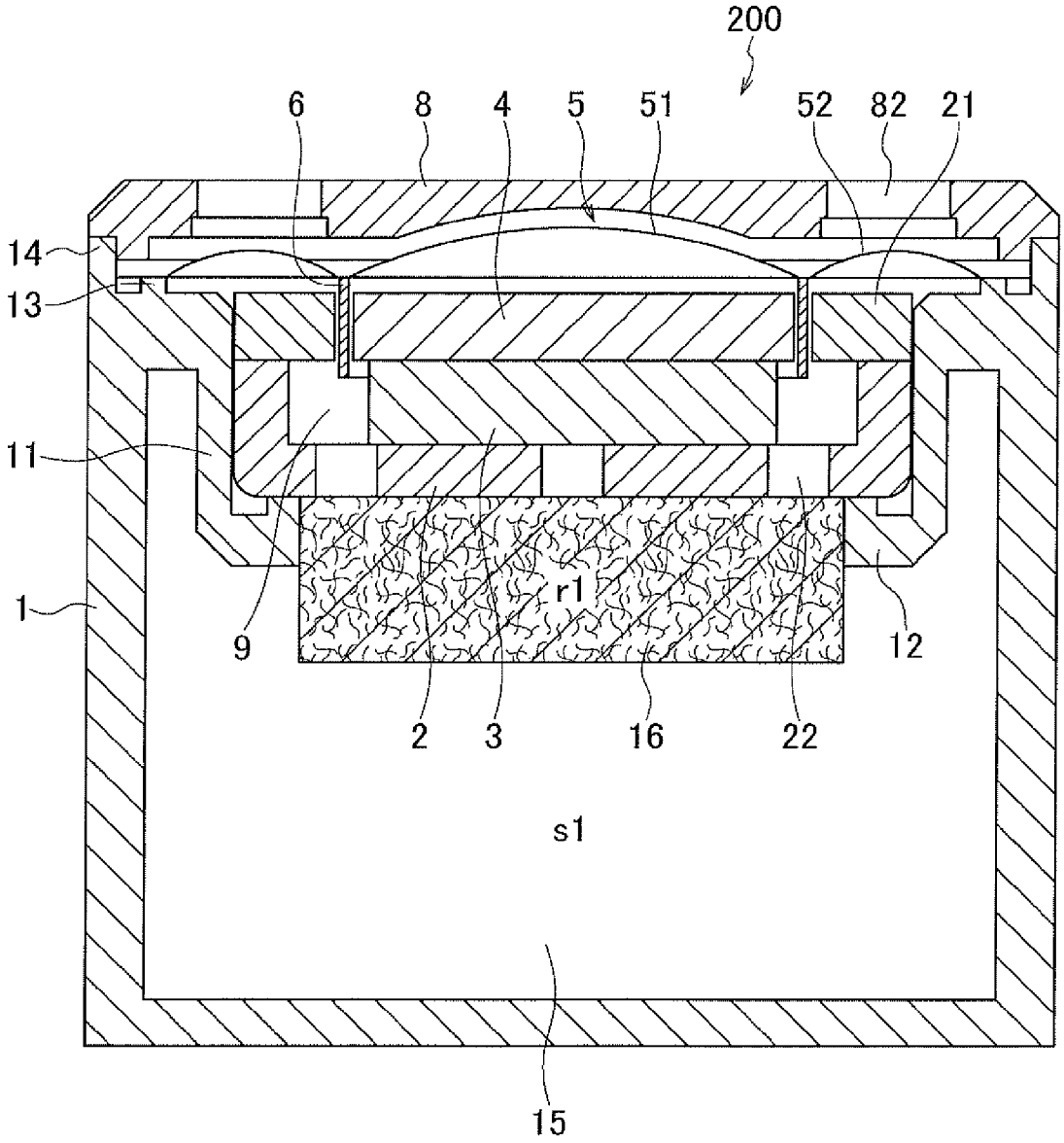
FIG. 7 (Related Art)
FIG. 7 is a longitudinal cross-sectional view illustrating a typical conventional dynamic microphone unit.
Figure 8:
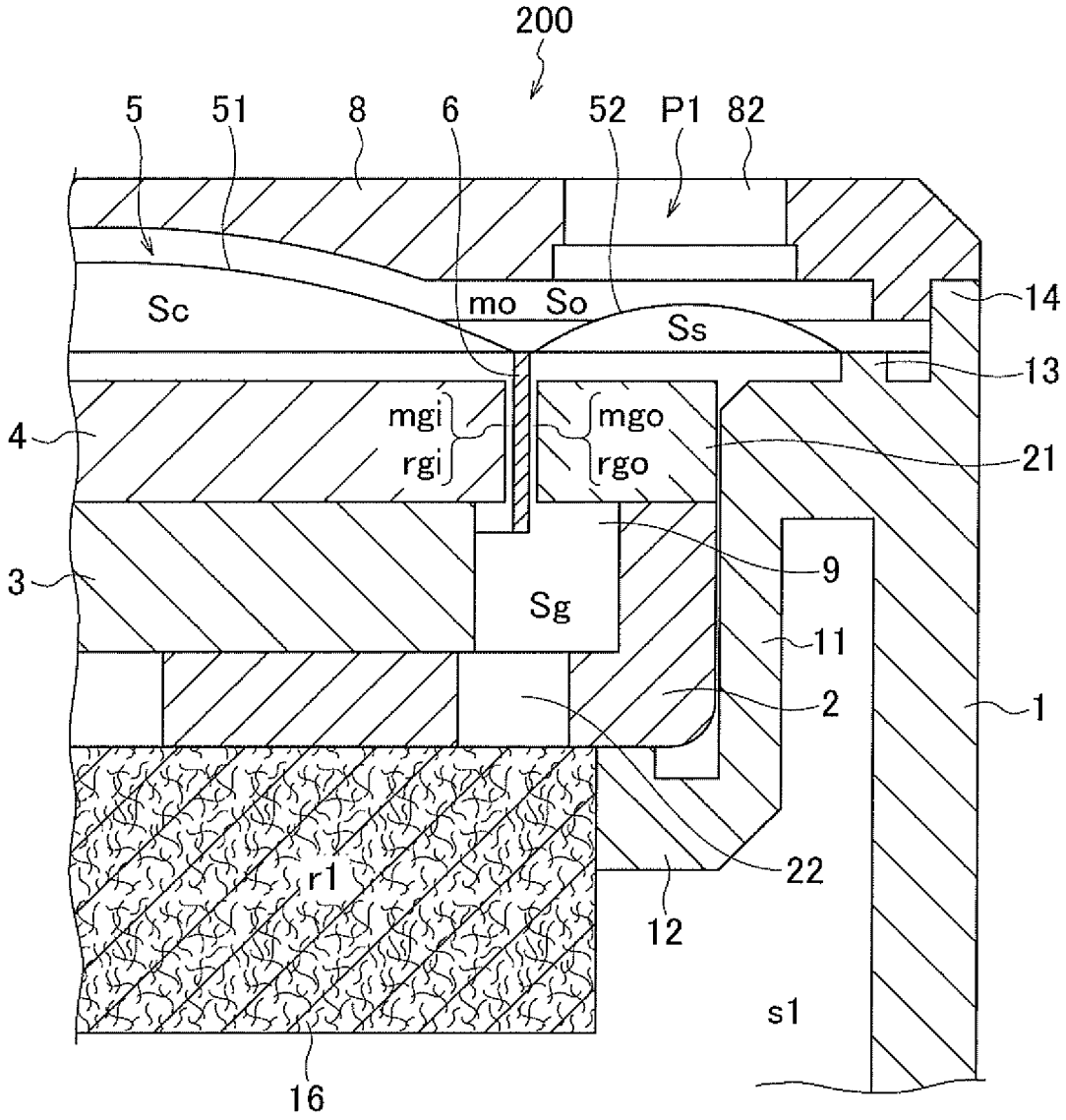
FIG. 8 (Related Art)
FIG. 8 is an enlarged longitudinal cross-sectional view illustrating a voice coil exceedingly displaced in the typical conventional dynamic microphone unit.
Figure 9:
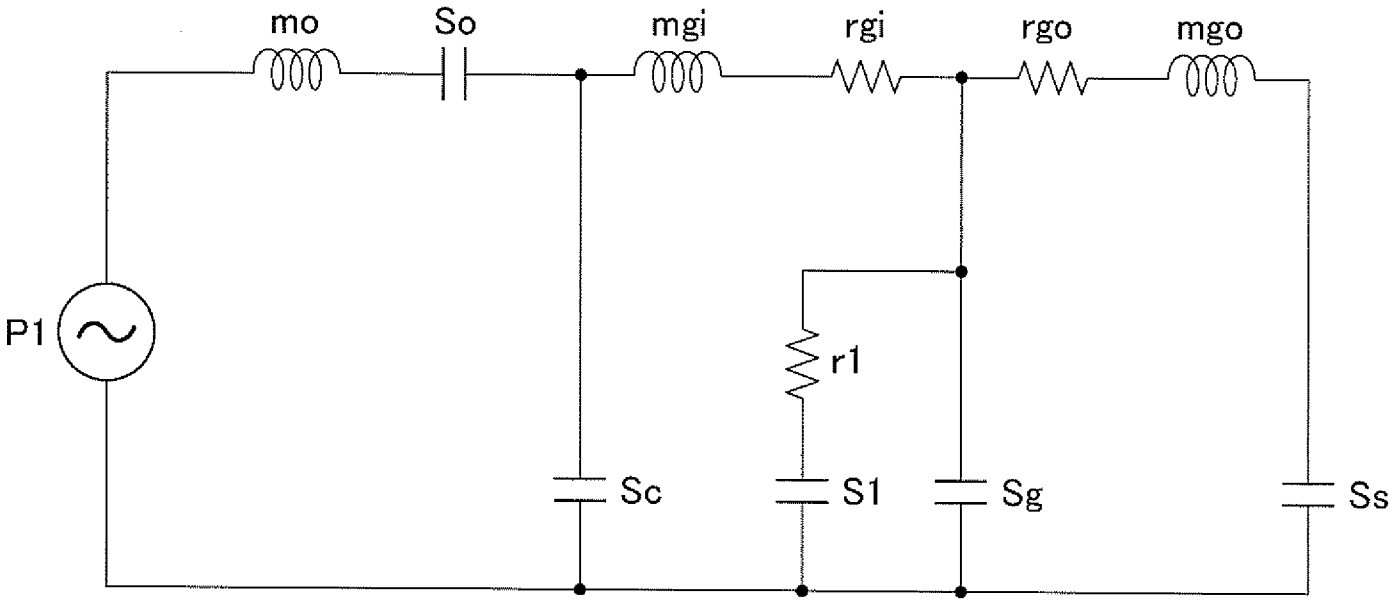
FIG. 9 (Related Art)
FIG. 9 is an equivalent circuit of the typical conventional dynamic microphone unit.
Figure 10:
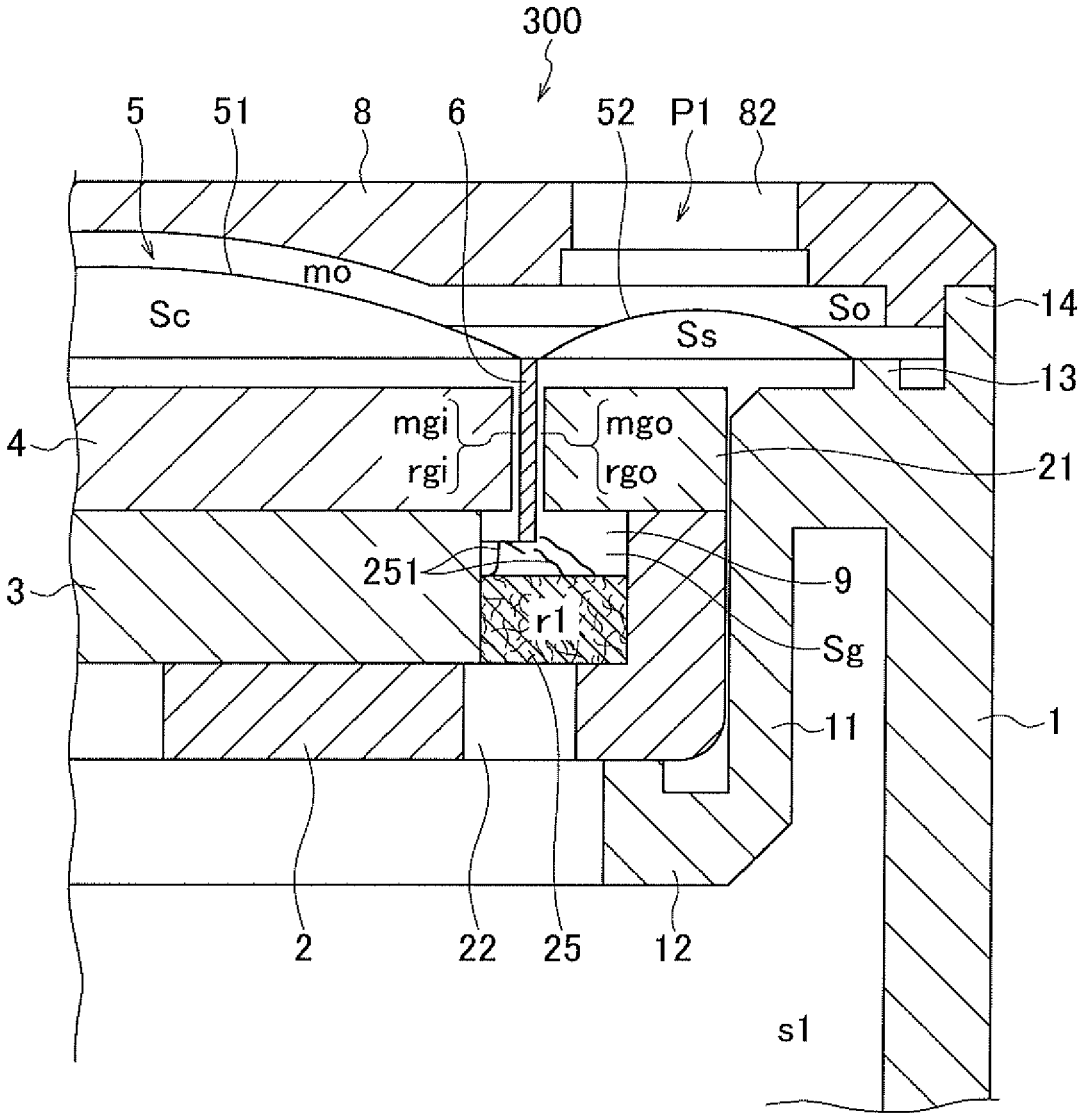
FIG. 10 (Related Art)
FIG. 10 is an enlarged longitudinal cross-sectional view illustrating another typical conventional dynamic microphone unit.
Figure 11:
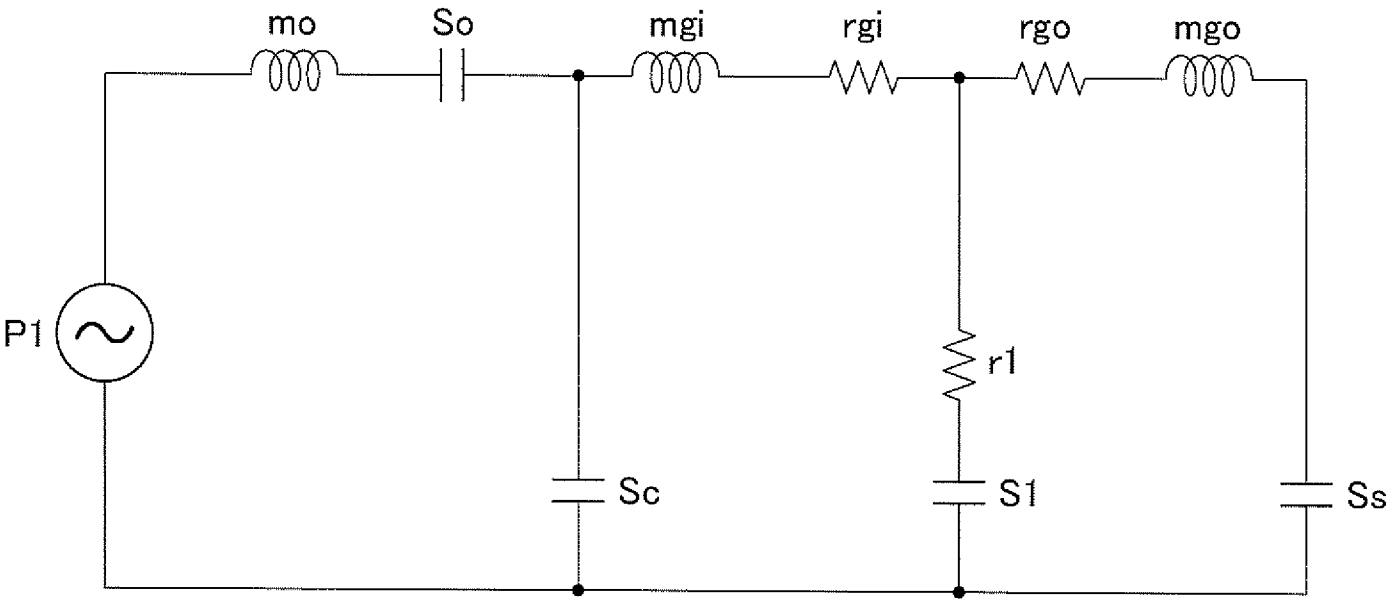
FIG. 11 (Related Art)
FIG. 11 is an equivalent circuit of the typical conventional dynamic microphone unit illustrated in FIG. 10.

A dynamic microphone unit in an embodiment of the present invention will now be described with reference to the accompanying drawings. A dynamic microphone in an embodiment of the present invention will also be described. The same elements as those of the conventional dynamic microphone unit illustrated in FIGS. 7, 8, and 10 are denoted by the same reference numerals.

Embodiments

Figure 1:
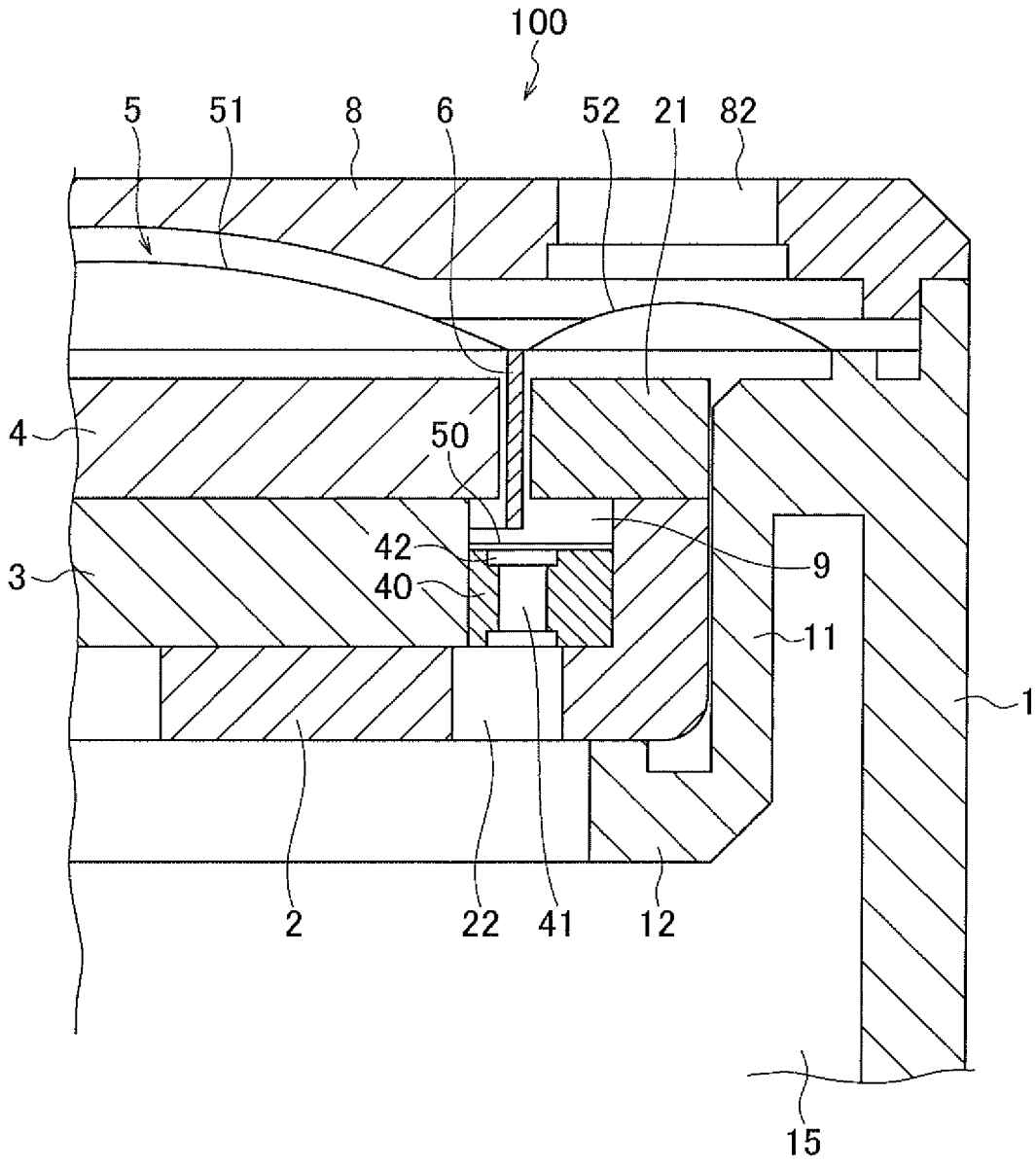
FIG. 1 is a longitudinal cross-sectional view illustrating a relevant portion of a dynamic microphone unit in an embodiment of the present invention.
Figure 2:
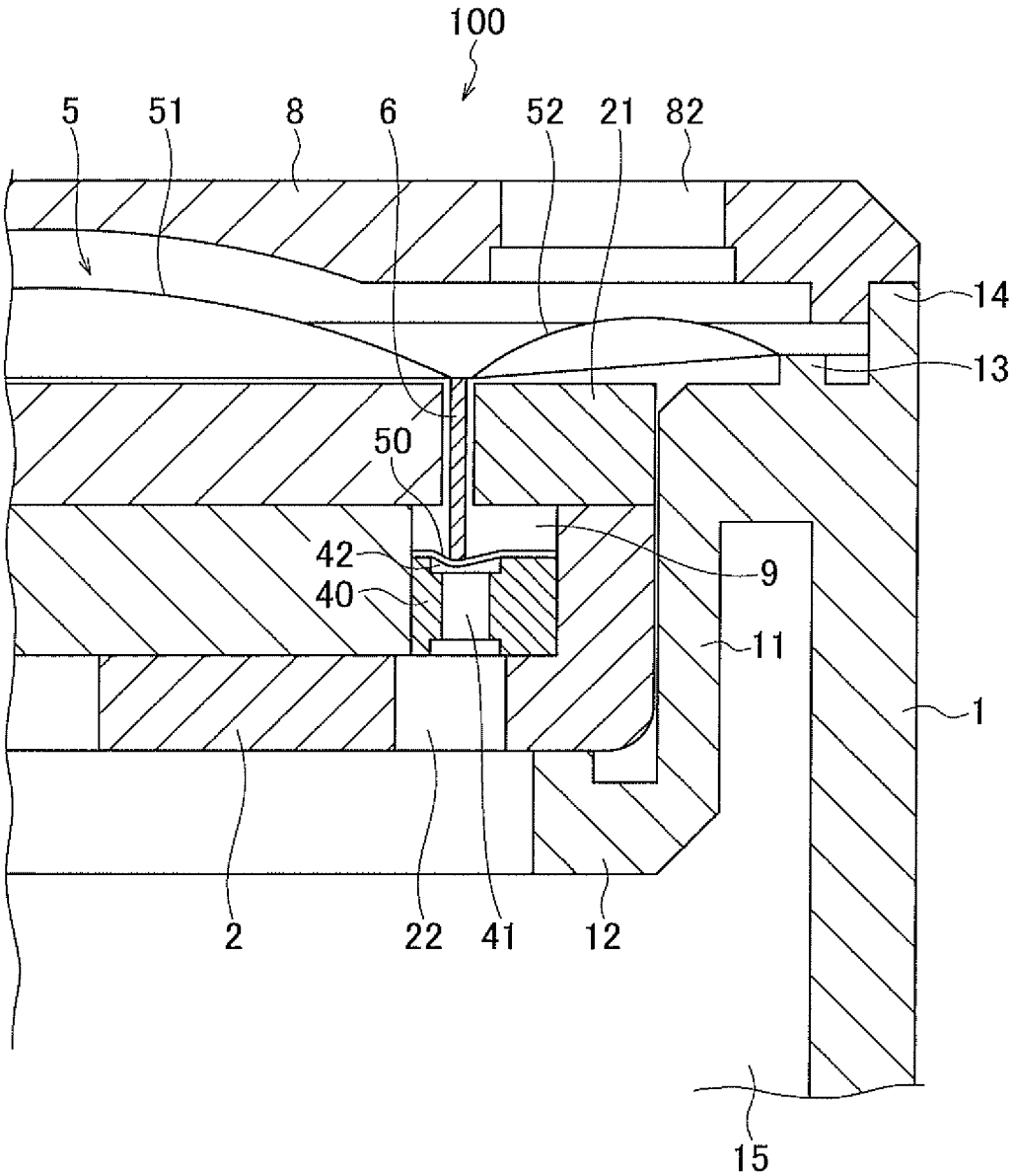
FIG. 2 is a longitudinal cross-sectional view illustrating a large displacement of a voice coil in contact with an acoustic resistor in the embodiment.

FIG. 1 is a longitudinal cross-sectional view illustrating a relevant portion of a dynamic microphone unit 100 in an embodiment of the present invention. FIG. 2 is a longitudinal cross-sectional view illustrating a large displacement of a voice coil in contact with an acoustic resistor in the dynamic microphone unit 100.

FIGS. 1 and 2 each illustrate a unit case 1 as a base of the dynamic microphone unit 100. The unit case 1 is a cylinder having a bottom surface, like that of the conventional unit. The unit case 1 has an inner cylinder 11 therein integrated with and vertically extending from the top of the unit case 1. The inner cylinder 11 has a flange 12 extending inward in the radial direction along the entire circumference of the bottom of the inner cylinder 11.

The inner cylinder 11 of the unit case 1 accommodates magnetic circuit components described below constituting a magnetic circuit. The flange 12 of the inner cylinder 11 supports a dish-shaped yoke 2 fixed into the inner cylinder 11. The outer surface of the circumferential wall of the yoke 2 is in contact with the inner circumferential surface of the inner cylinder 11. A disk-shaped magnet 3 bonded to the bottom plate of the yoke 2 has a smaller outer diameter than the inner diameter of the circumferential wall of the yoke 2. A disk-shaped pole piece 4 is bonded to the magnet 3. A ring yoke 21 is bonded to the top surface of the circumferential wall of the yoke 2. The pole piece 4 has almost the same thickness as that of the ring yoke 21. The pole piece 4 is fixed so as to be substantially flush with the ring yoke 21. The outer circumferential surface of the pole piece 4 faces the inner circumferential surface of the ring yoke 21 with a proper gap to define a round magnetic gap. These magnetic circuit components are contained in the inner cylinder 11. The top surface of the pole piece 4 is substantially flush with the top surface of the inner cylinder 11.

A magnetic flux from the magnet 3 returns to the magnet 3 through a magnetic circuit composed of the yoke 2, the ring yoke 21, the magnetic gap, and the pole piece 4. In other words, the magnetic flux traverses the magnetic gap. The magnet 3 has a smaller outer diameter than the outer diameter of the pole piece 4. A second air chamber 9 having a larger width than that of the magnetic gap is defined between the outer circumferential surface of the magnet 3 and the inner circumferential surface of the ring yoke 21 below the magnetic gap. The yoke 2 has multiple through holes 22 at the bottom portion. The holes 22 connect the air chamber 9 through a space surrounded by the round flange 12 of the unit case 1 to a relatively large first air chamber 15 in the unit case 1. The first air chamber 15, which is a main air chamber, is defined adjacent to the reverse of a diaphragm 5. The second air chamber 9 below the magnetic gap is smaller than the first air chamber 15.

The unit case 1 has a projection edge 14 along the outer circumference at the top. The unit case 1 also has a concentric projection 13 inside the projection edge 14, the projection 13 having a lower height than the projection edge 14 on the top of the unit case 1. The circumferential edge of a diaphragm 5 is fixed on the top surface of the projection 13. The diaphragm 5 is a thin film composed of a material such as synthetic resin or metal. The diaphragm 5 includes a center dome 51 and a sub-dome 52 surrounding the center dome 51. The center dome 51 is a partial spherical shell. The sub-dome 52 has an arc-shaped cross section and extends along the circumferential edge of the center dome 51. The diaphragm 5 is fixed at its outer circumferential edge of the sub-dome 52, on the top surface of the projection 13. This enables the diaphragm 5 to vibrate in response to the sound pressure from sound waves, in the anteroposterior direction (the vertical direction in FIGS. 1 and 2) around the outer circumferential edge of the sub-dome 52 as a supporting node.

A voice coil 6 is fixed along a round boundary line between the center dome 51 and the sub-dome 52 in the diaphragm 5. The voice coil 6 is formed by winding a thin conductive wire and by fixing it into a cylindrical shape. One end of the cylindrical voice coil 6 is fixed to the diaphragm 5. The voice coil 6 is disposed in the magnetic gap while the outer circumferential edge of the sub-dome 52 of the diaphragm 5 is fixed as described above. In this state, the voice coil 6 is separated from both the ring yoke 21 and the pole piece 4.

Near the obverse of the diaphragm 5, an equalizer 8 functioning also as a protector for the diaphragm 5 is fixed, at its circumferential edge, to the projection edge 14 of the unit case 1. The equalizer 8 has a ceiling surface having a dome shape in the center. A gap with a predetermined distance is defined between the ceiling surface and the center dome 51 of the diaphragm 5. The equalizer 8 has multiple holes 82 for introducing sound waves from the exterior to the diaphragm 5.

The diaphragm 5 vibrates in the anteroposterior direction in response to a variation in the sound pressure from sound waves. The voice coil 6 also vibrates in the anteroposterior direction in cooperation with vibration of the diaphragm 5. The voice coil 6 vibrates in the anteroposterior direction to traverse the magnetic flux passing through the magnetic gap. The voice coil 6 traverses the magnetic flux to generate electric power as audio signals in response to a variation in the sound pressure. A dynamic microphone unit 100 electroacoustically converts the signals as described above. For example, audio signals are outputted from both ends of the voice coil 6 wired along the reverse of the sub-dome 52 to the exterior.

In the dynamic microphone unit 100 of the present embodiment, a elastic thin-plate acoustic resistor 50 is disposed in the second air chamber 9 while having tensile force applied, at a position where the acoustic resistor 50 can limit the volume of the second air chamber 9 and come into contact with the voice coil 6 within a maximum displacement of the voice coil 6. The second air chamber 9 having a round shape concentric with the cylindrical voice coil 6 is provided between the outer circumferential surface of the magnet 3 and the inner wall of the yoke 2. The dynamic microphone unit 100 includes a ring acoustic resistor holder 40 in the round second air chamber 9.

Figure 3:
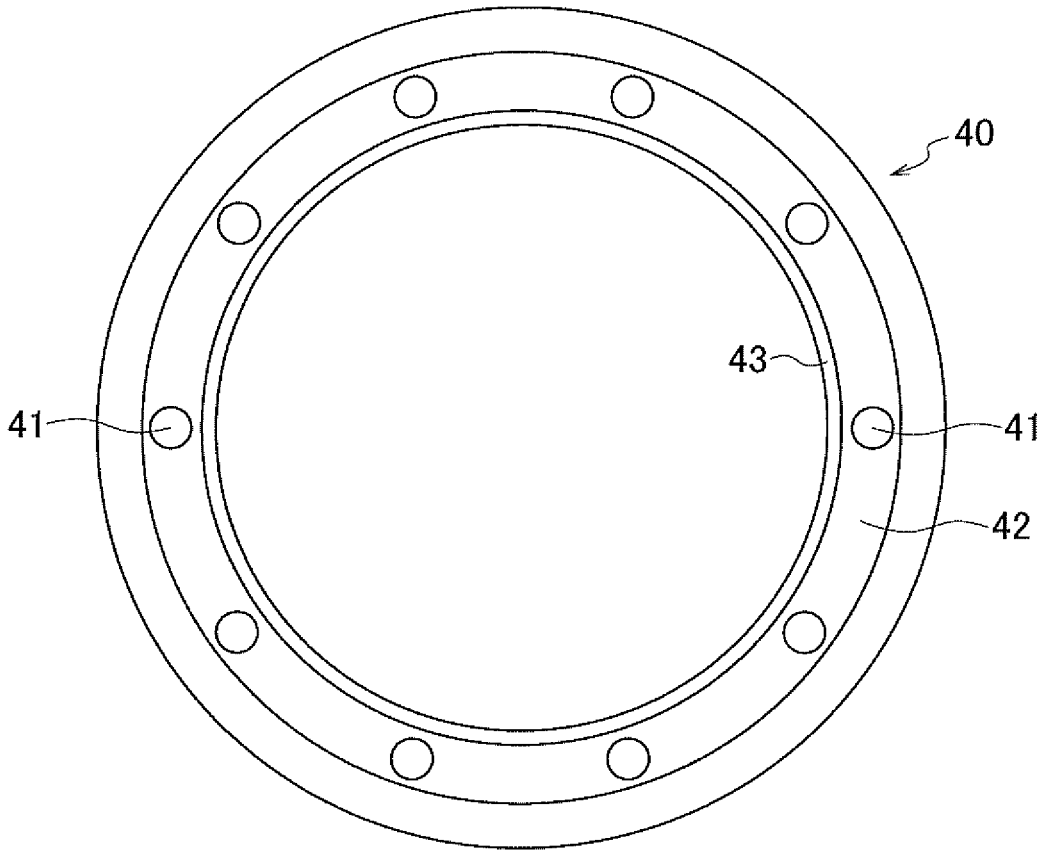
FIG. 3 is a plane view illustrating an acoustic resistor holder in the embodiment.
Figure 4:
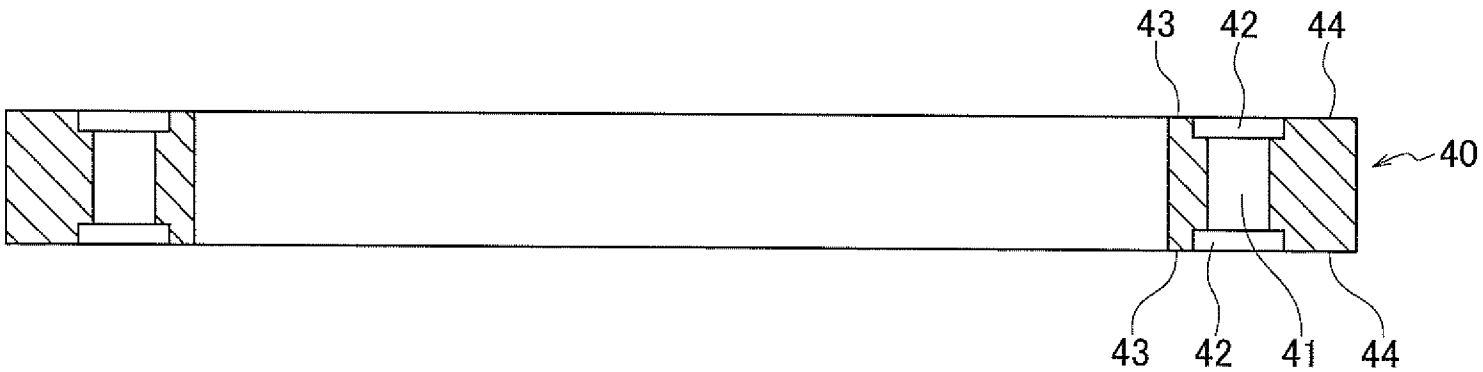
FIG. 4 is a longitudinal cross-sectional view illustrating the acoustic resistor holder.

FIGS. 3 and 4 illustrate a structure of the acoustic resistor holder 40. In FIGS. 3 and 4, grooves 42 having predetermined widths are provided on the top and bottom surfaces of and concentrically with the ring acoustic resistor holder 40. Round flat surfaces 43 and 44 are provided on both sides of, i.e., on the inner and outer circumferences of the grooves 42. The acoustic resistor holder 40 has a symmetric shape such that the holder can be used upside down. The grooves 42 have multiple through holes 41 in the vertical direction (the thickness direction) through the acoustic resistor holder 40 along the circumferential direction at equal intervals. The acoustic resistor 50 is fixed to one of the top and bottom surfaces of the acoustic resistor holder 40 and to the top surface in the example in the drawings. As illustrated in FIGS. 1 and 2, the acoustic resistor 50 covers the groove 42 from above. As a result, the acoustic resistor 50 also covers the holes 41 from above.

Figure 5:
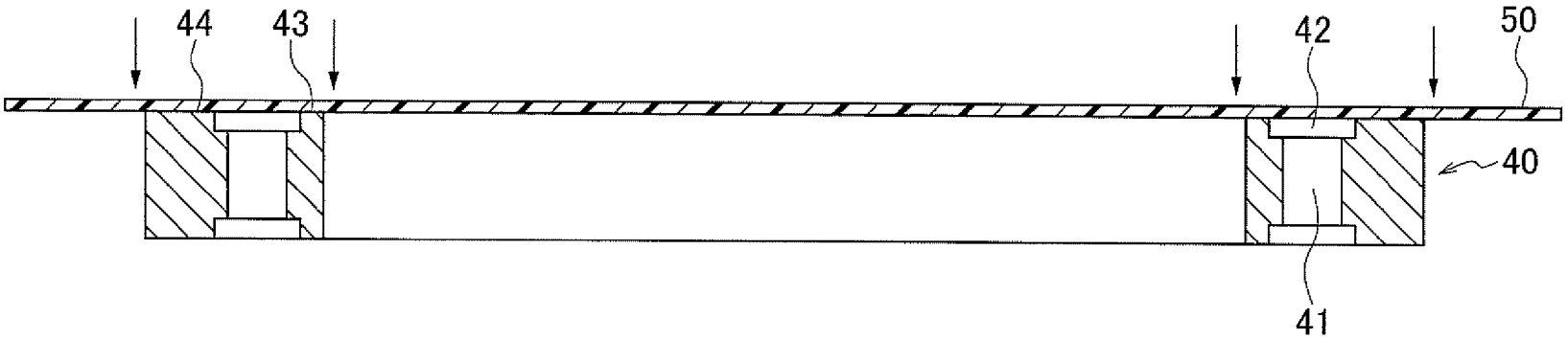
FIG. 5 is a longitudinal cross-sectional view illustrating a part of a process for fixing the acoustic resistor on the acoustic resistor holder.
Figure 6:
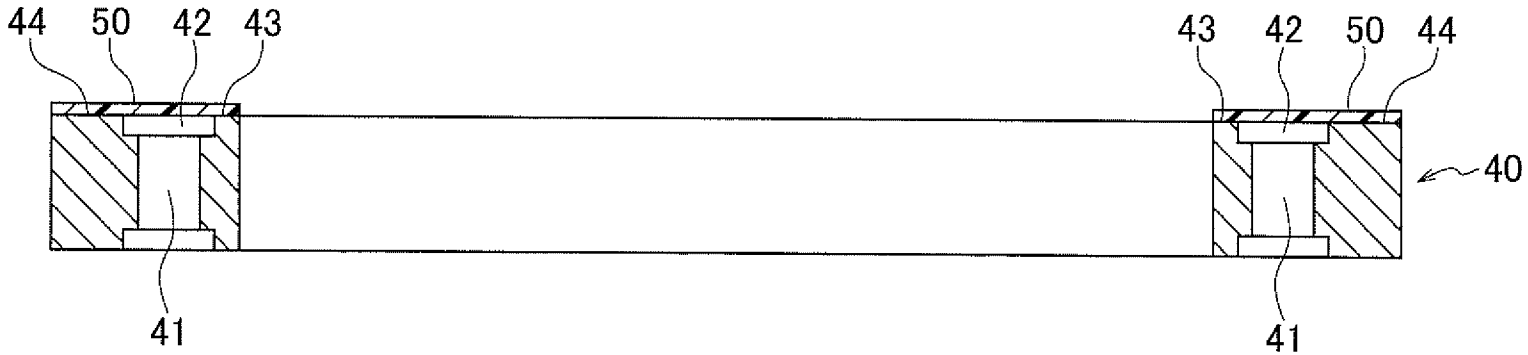
FIG. 6 is a longitudinal cross-sectional view illustrating a complete assembly of the acoustic resistor and the acoustic resistor holder after the process for fixing.

FIGS. 5 and 6 illustrate typical fixation of the acoustic resistor 50 to the acoustic resistor holder 40. FIG. 5 illustrates the acoustic resistor 50 fixed to the top surface of the acoustic resistor holder 40. The acoustic resistor 50 is composed of a material that has proper acoustic resistance and can warp in response to external force while proper tensile force is applied. For example, such a material is a nylon mesh. Prior to the state illustrated in FIG. 5, the acoustic resistor 50 is fixed to the acoustic resistor holder 40 through processes described below. Proper tensile force is applied to pre-fix the circumferential edge of the thin-plate acoustic resistor 50 to a flat surface such as a surface plate with, for example, an adhesive tape. An adhesive material is then applied to the inner flat surface 43 and the outer flat surface 44 on one side of the acoustic resistor holder 40. The surface of the acoustic resistor holder 40 with the applied adhesive material is biased to the material of the acoustic resistor 50 having tensile force applied as described above. This state is kept until the adhesive material is cured.

FIG. 5 illustrates the acoustic resistor holder 40 turned upside down after the acoustic resistor holder 40 is fixed to the acoustic resistor 50 with the hardened adhesive material. As indicated by an arrow in FIG. 5, the acoustic resistor 50 is cut off along the inner and outer circumferences of the acoustic resistor holder 40. FIG. 6 illustrates the acoustic resistor holder 40 and the acoustic resistor 50 assembled as described above.

As illustrated in FIGS. 1 and 2, the assembly of the acoustic resistor holder 40 and the acoustic resistor 50 is fixed while the bottom surface of the acoustic resistor holder 40 abuts the inner bottom surface of the yoke 2 in the second air chamber 9. As a result of the assembling, the acoustic resistor holder 40 holds the acoustic resistor 50 on the surface adjacent to the voice coil 6. The acoustic resistor holder 40 and the acoustic resistor 50 limit the second air chamber 9 to a significantly small volume adjacent to the voice coil 6. The bottom of the voice coil 6 faces the groove 42 of the acoustic resistor holder 40. The acoustic resistor 50 covering the groove 42 from the top surface is disposed so as to come into contact with the voice coil 6 within the maximum displacement. In other words, the voice coil 6 is significantly displaced toward the acoustic resistor 50 to bring the bottom of the voice coil 6 into contact with the acoustic resistor 50, as illustrated in FIG. 2. The voice coil 6 is also displaced toward the acoustic resistor 50 to warp the acoustic resistor 50 downward.

The elastic acoustic resistor 50 with applied tensile force is held above the groove 42 of the acoustic resistor holder 40. The bottom of the voice coil 6 is therefore separated from the acoustic resistor 50 to return the acoustic resistor 50 to a flat plate, as illustrated in FIG. 1. As a result, the acoustic resistor 50 functions as a damper absorbing energy of collision of the bottom of the voice coil 6 with the acoustic resistor 50. In other words, the acoustic resistor 50 absorbs impact force caused by collision of the voice coil 6 to eliminate or reduce impact noise.

The acoustic resistor holder 40 does not directly fix the acoustic resistor 50 to the holes 41 through which the first air chamber 15 is in communication with the second air chamber 9. In other words, the acoustic resistor holder 40 has the groove 42 having a larger width than the diameters of the holes 41 along the entire circumference above the holes 41. Additionally, the acoustic resistor 50 is fixed to the acoustic resistor holder 40 so as to cover the groove 42 from above. The groove 42 in the acoustic resistor holder 40 therefore provides a larger area for warping of the acoustic resistor 50 caused by collision of the voice coil 6 than the area of a groove having a width corresponding to the diameters of the holes 41. In other words, the groove 42 in the acoustic resistor holder 40 can effectively reduce impact noise caused by collision of the voice coil 6 with the acoustic resistor 50.

In the conventional dynamic microphone as described above, both ends of a wire of the voice coil 6 are fixed along the reverse of the sub-dome 52 of the diaphragm 5 for output of signals to the exterior. In the conventional dynamic microphone, a large displacement of the diaphragm 5 may cut the wire of the voice coil 6 due to collision of the end of the wire with a portion of the magnetic circuit such as the edge of the ring yoke 21. In the dynamic microphone unit 100 of the present embodiment, the acoustic resistor 50 can limit the downward displacement of the voice coil 6 and the diaphragm 5 fixed to the voice coil 6 in FIGS. 1 and 2, as described above. The dynamic microphone unit 100 therefore has another advantage of prevention of cutting the wire of the voice coil 6 due to collision of the end of the wire with a portion of the magnetic circuit.

In the dynamic microphone unit 100 of the present embodiment, the volume of the second air chamber 9 behind the voice coil 6 is limited by the thin-plate acoustic resistor 50 and the acoustic resistor holder 40 holding the acoustic resistor 50. The dynamic microphone unit 100 therefore prevents resonance of the acoustic mass of the magnetic gap and the acoustic capacitance of the second air chamber 9. This provides proper frequency characteristics of the dynamic microphone unit 100.

The dynamic microphone unit 100 in the present embodiment is assembled in a microphone case including a microphone connector for outputting of output signals from the microphone unit to the exterior, which can complete a dynamic microphone.

What is claimed is:

1. A dynamic microphone unit comprising:

a diaphragm vibrating in response to received sound waves;

a voice coil fixed to the diaphragm and vibrating in cooperation with the diaphragm;

a magnetic circuit generating magnetism in a magnetic gap, the voice coil being disposed in the magnetic gap;

a first air chamber defined adjacent to the reverse of the diaphragm;

a second air chamber defined behind the voice coil, the second air chamber being in communication with the first air chamber; and an elastic thin-plate acoustic resistor separated from the voice coil and held on a surface adjacent to the voice coil, wherein the elastic thin-plate acoustic resistor is disposed in the second air chamber at a position where the elastic thin-plate acoustic resistor comes into contact with the voice coil within a maximum displacement of the voice coil.

2. The dynamic microphone unit according to claim 1, further comprising:

a ring acoustic resistor holder is disposed in the second air chamber, wherein the voice coil has a cylindrical shape, the second air chamber has a round shape concentric with the voice coil, and wherein the ring acoustic resistor holder holds the elastic thin-plate acoustic resistor at a position facing the voice coil.

3. The dynamic microphone unit according to claim 1, wherein the elastic thin-plate acoustic resistor comprises a flexible material and is fixed to a ring acoustic resistor holder under tension.

4. The dynamic microphone unit according to claim 2, wherein the ring acoustic resistor holder has a hole through which the first air chamber is in communication with the second air chamber, and the acoustic resistor is disposed to cover the hole.

5. The dynamic microphone unit according to claim 4, wherein the ring acoustic resistor holder has a groove having a larger width than the diameter of the hole, on the surface adjacent to the acoustic resistor.

6. The dynamic microphone unit according to claim 1, wherein the magnetic circuit includes a yoke, a magnet fixed to the yoke, and a pole piece fixed to the magnet, and wherein the yoke has a hole through which the first air chamber is in communication with the second air chamber.

7. A dynamic microphone comprising:

a dynamic microphone unit having:

a diaphragm vibrating in response to received sound waves;

a voice coil fixed to the diaphragm and vibrating in cooperation with the diaphragm;

a magnetic circuit generating magnetism in a magnetic gap, the voice coil being disposed in the magnetic gap;

a first air chamber defined adjacent to the reverse of the diaphragm;

a second air chamber defined behind the voice coil, the second air chamber being in communication with the first air chamber; and an elastic thin-plate acoustic resistor separated from the voice coil and held on a surface adjacent to the voice coil, wherein the elastic thin-plate acoustic resistor is disposed in the second air chamber at a position where the elastic thin-plate acoustic resistor comes into contact with the voice coil within a maximum displacement of the voice coil.

8. The dynamic microphone unit according to claim 1, wherein the elastic thin-plate acoustic resistor and the position are such that the elastic thin-plate acoustic resistor warps when the elastic thin-plate acoustic resistor comes into contact with the voice coil.

* * * * *

UNITED STATES PATENT AND TRADEMARK OFFICE

CERTIFICATE OF CORRECTION

PATENT NO. : 8,761,427 B2
APPLICATION NO. : 13/587274
DATED : June 24, 2014
INVENTOR(S) : Hiroshi Akino It is certified that error appears in the above-identified patent and that said Letters Patent is hereby corrected as shown below:

In the Claims:

Column 10, claim 2, line 8, after "holder" delete "is"

Signed and Sealed this
Seventh Day of October, 2014

Michelle K. Lee

Michelle K. Lee
*Deputy Director of the United States Patent and Trademark Office*